US006746334B1

(12) United States Patent
Barney

(10) Patent No.: US 6,746,334 B1
(45) Date of Patent: Jun. 8, 2004

(54) PLAY STRUCTURE WITH ACTIVE TARGETING SYSTEM

(75) Inventor: Jonathan A. Barney, Newport Beach, CA (US)

(73) Assignee: Creative Kingdoms, LLC, Wakefield, RI (US)

( * ) Notice: Subject to any disclaimer, the term of this patent is extended or adjusted under 35 U.S.C. 154(b) by 0 days.

(21) Appl. No.: 10/330,823

(22) Filed: Dec. 27, 2002

(51) Int. Cl.[7] ..... A63G 31/00
(52) U.S. Cl. ..... 472/128; 273/349
(58) Field of Search ..... 472/128, 137; 273/348, 349, 440, 453, 357, 355, 356, 406, 384

(56) References Cited

U.S. PATENT DOCUMENTS

| | | | | |
|---|---|---|---|---|
| 1,789,680 A | | 1/1931 | Gwinnett | |
| 3,336,030 A | | 8/1967 | Martell et al. | |
| 3,395,920 A | | 8/1968 | Moe | |
| 3,572,712 A | | 3/1971 | Vick | |
| 3,843,127 A | | 10/1974 | Lack | |
| 5,011,161 A | | 4/1991 | Galphin | |
| 5,194,048 A | | 3/1993 | Briggs | |
| 5,411,269 A | * | 5/1995 | Thomas | 273/349 |
| 5,435,569 A | * | 7/1995 | Zilliox | 273/349 |
| 5,586,767 A | | 12/1996 | Bohland | |
| 5,779,240 A | | 7/1998 | Santella | |
| 5,785,592 A | | 7/1998 | Jacobsen | |
| 5,853,332 A | | 12/1998 | Briggs | |
| 5,855,372 A | | 1/1999 | Thiemann | |
| 5,893,562 A | * | 4/1999 | Spector | 273/349 |
| 5,980,254 A | | 11/1999 | Muehle et al. | |
| 6,210,287 B1 | | 4/2001 | Briggs | |

* cited by examiner

*Primary Examiner*—Kien T. Nguyen
(74) *Attorney, Agent, or Firm*—Jonathan A. Barney

(57) ABSTRACT

The present invention provides an interactive play structure including an active targeting system for automatically sensing the location of a play participant and spraying or propelling water or other play media at the sensed location. Play participants race against the clock to determine and enter a secret code to disable the active targeting system or otherwise activate a desired self-destruct sequence or other desired sequence of events. But the active targeting system sprays water or shoots other play media at play participants who attempt to approach the structure. The secret code is periodically scrambled so that play participants must act quickly and cooperate with one another to determine and enter the correct code. These and other improvements increase the challenge and enjoyment of interactive play structures incorporating such improvements.

39 Claims, 5 Drawing Sheets

PLAY STRUCTURE WITH ACTIVE TARGETING SYSTEM

RELATED APPLICATIONS

This application is based on U.S. Ser. No. 09/772,168, filed Jan. 29, 2001 (published Mar. 14, 2002 as Pub. No. US 2002/0032067A1), the entire disclosure of which is incorporated by reference, and provisional application Ser. No. 60/178,353, filed Jan. 27, 2000.

BACKGROUND OF THE INVENTION

1. Field of the Invention

The present invention relates to children's play attractions and, in particular, to interactive play attractions for use in family entertainment facilities, theme parks, water parks and the like.

2. Description of the Related Art

Interactive play attractions are known for use in family entertainment facilities, theme parks, water parks and the like. For example, U.S. Pat. No. 5,194,048 to Briggs discloses an interactive water play structure for use in a "wet" play environment, such as a water park or the like. U.S. Pat. No. 5,853,332 to Briggs discloses an interactive play structure for use in a "dry" or "semi-dry" play environment. Each of these patents is incorporated herein by reference as though fully reproduced herein.

SUMMARY OF THE INVENTION

The present invention expands and improves upon the concept of interactive play and interactive play structures by providing additional interactive theming, play elements and targeting features. In one embodiment the present invention provides an interactive play structure comprising an active targeting system for automatically sensing the location of a play participant and spraying or propelling water or other play media at the sensed location. Other embodiments of the invention include methods of interactive play wherein play participants must race against the clock to determine and enter a secret code to activate a desired self-destruct sequence or other desired sequence of events. The secret code is periodically scrambled so that play participants must act quickly and cooperate with one another to determine and enter the correct code. These and other improvements disclosed herein increase the challenge and enjoyment of interactive play structures incorporating such features and improvements.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recog-nize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1:
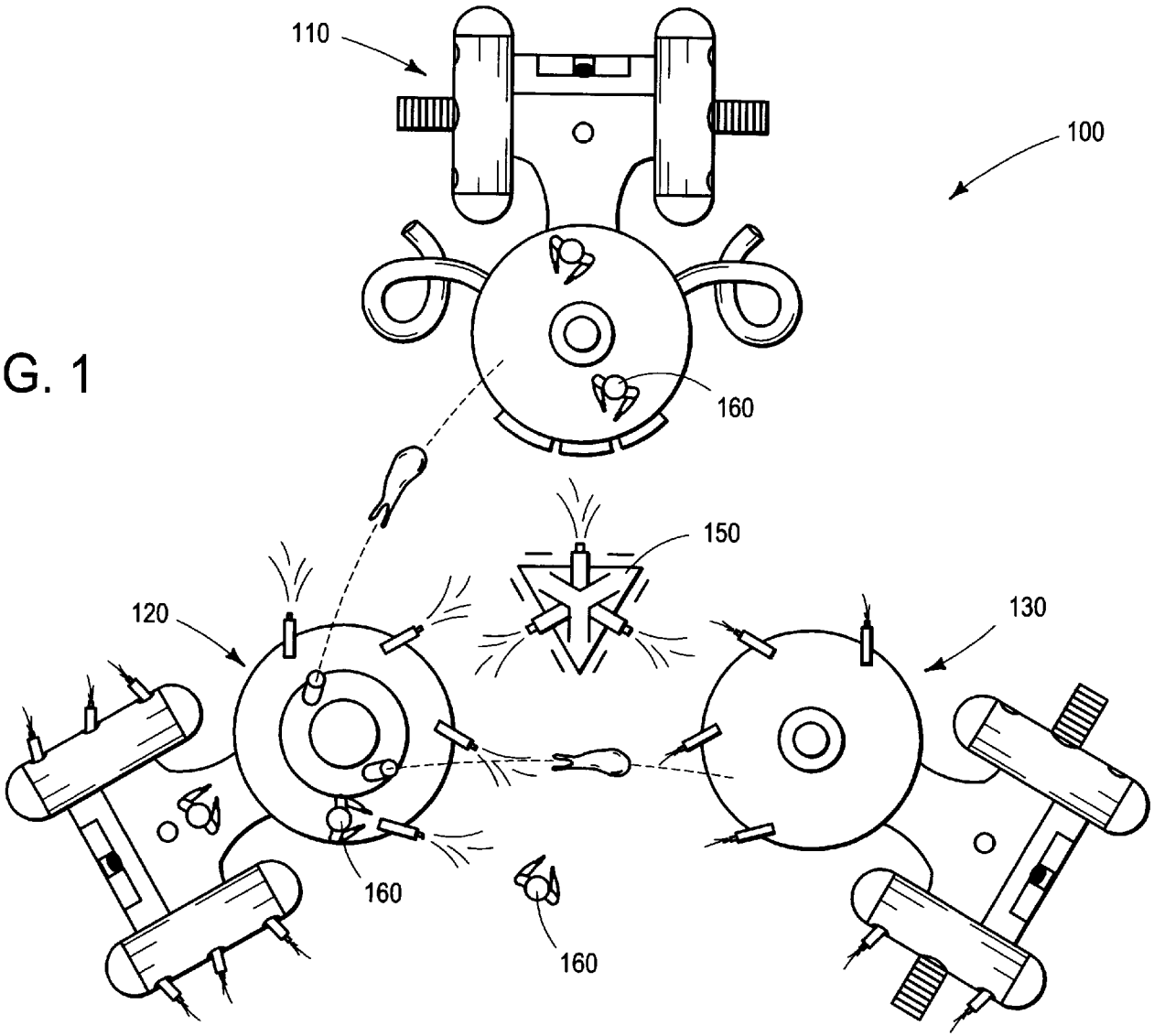
FIG. 1 is top plan view of an interactive play system having features and advantages in accordance with the present invention comprising multiple themed space ship play structures disposed around a central target.
Figure 2:
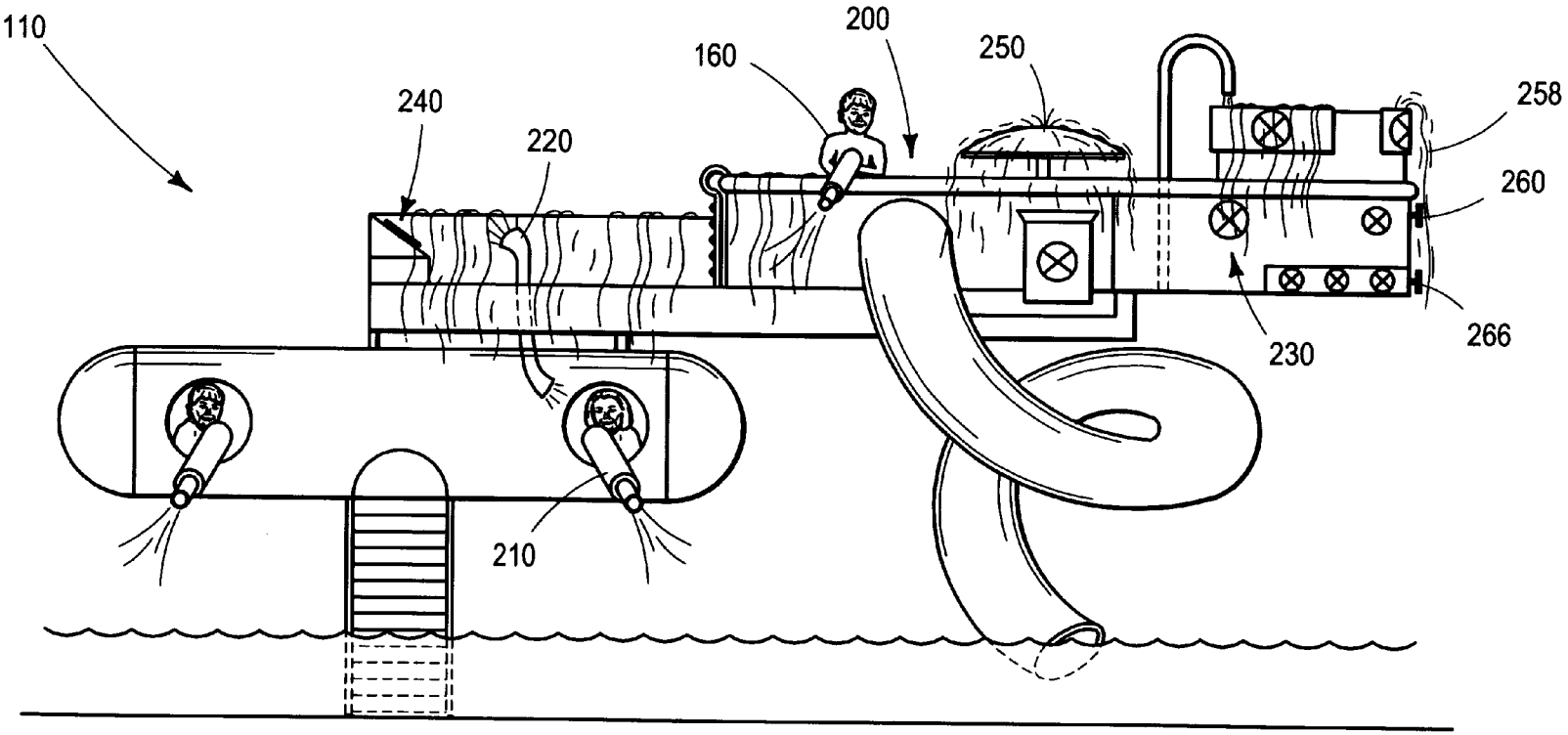
FIG. 2 is front elevational view of one of the themed space ship play structures of FIG. 1.

FIGS. 1 and 2 are top plan and front elevation views, respectively, of an interactive play system 100 having features and advantages in accordance with the present invention. This particular play system 100 is provided in the theme of an outer space battle comprising multiple themed space ship play structures 110, 120, 130 disposed around a central target 150. Thus, play participants 160 can imagine they are aboard the Starship Enterprise or any other similar imaginary or real space vessel. Of course, any one of a number of alternative themes may be used with efficacy, such as one or more fire engines, pirate ships, battle ships, or the like.

In accordance with the particular "Star Trek™" theme illustrated, for example, play participants 160 can imagine that their ships 110, 120, 130 are locked in a face-to-face dual to the death battle with one another. One or more of the ships may be themed as Klingon battle cruisers or the like, as desired. Each space ship is manned by a team of play participants 160, which assume the imaginary roles of highly skilled technical personnel, helmsmen and weapons systems operators and the like. As each ship falls under increasing attack, critical systems begin to falter and then fail. Play participants must think quickly and work effectively with fellow shipmates in order to thwart the opposing ships' attacks, execute necessary countermeasures, make appropriate repairs, and launch counter-attacks, in order to avert ultimate disaster. The mission may be to destroy (or incapacitate) the enemy ships before they destroy (or incapacitate) your ship.

Basic Play Structure

Three multilevel play structures 110, 120, 130 themed as space vessels are situated in a water play area and arranged in a three-way face-off (e.g. FIG. 1). At least a portion of each play structure is generally simulative of the bridge or command center 200 of a space vessel and contains various interactive play areas simulating, for example, weapons systems controls 210, helm controls 220, shields control 230, propulsion and maneuvering and communications. An engineering section 240 might also be provided in each play structure for allowing play participants to direct and maintain operating power (water flow) to the various systems on each ship (e.g. FIG. 2).

For example, the engineering section might allow play participants to actuate various switches, valves, and/or the like in order to divert power (water flow or other simulated power source) away from failed systems or less critical systems and to increase power (water flow) to more critical systems as appropriate under the particular situation or scenario being played out. The various interactive devices can be either wet or dry or both.

The primary resource for driving virtually all of the various systems is preferably water, although various other play media may be used, including foam balls, simulated crystals, or any other tangible or intangible (e.g. created by software) play media. If water is used, it can be pumped to the various system components by play participants 160 in the engineering section or in a particular portion of the bridge by actuating various pumping devices and the like. Alternatively, water may be provided by a central circulation pump. Water flow can be used to feed the weapon systems, the shields, propulsion systems and the like.

Each play structure 110, 120, 130 may either be fixed or movable (either up/down and/or rotationally). For example, each play structure (or portion thereof) may be rotatable such that play participants can rotate the angle of their ship in order to gain strategic defensive or offensive advantage and also to simulate the maneuvering of their craft. Optionally, hydraulic lifting up and down of the ship or portion thereof may also be provided so that the ships cannot only rotate back and forth but can also be lifted hydraulically up and down from the ground in order to again simulate maneuverability of the ship. This can be provided, for example, by hydraulic cylinders or other means. Only a few feet of maneuverability need be provided. The play structure 110 can be connected to the ground surface or additional adjacent play surface by a rope netting, cargo netting, or other kind of flexible connector device that facilitates such movement. The hydraulic cylinders can also be pulsed or periodically actuated to provide vibration and/or other effects simulating the sound and vibration of a large spacecraft under various power loading conditions. Jolting or vibrations can also simulate impacts caused by enemy fire.

A computer software program is preferably used to provide a voice on each bridge continuously announcing various events as they occur and the status of various shipboard systems and components. The computer voice may announce, for example, "shield strength down to 40%," "weapons down to 20%," "core containment field down to 15%," "core breach imminent," and the like. Sound can either be provided using water-proof speakers and the like or using a remote sound system with sound "piped in" using hollow pipes extending down into each play structure, as is well-known in the art. One or more computers and associated software can also be used to track and announce the various events and operate additional interactive effects.

Additional effects are also preferably provided to help simulate the experience of being in a space ship battle. For example, shields/deflectors 250 can be provided in the form of water curtains that fall down over the front of certain targets 260. The targets are sized and arranged so as to be actuated by a stream of water or other play media propelled from an opposing ship. The shields can be created, for example, by pumping water to a reservoir and over a weir to cause water to fall down in a cascade of smooth sheet water flow which visually and/or physically blocks associated target areas. There can be multiple shields provided to help block access to various portions of the ship and/or its occupants.

Optionally, the shields 250 can be rotated or transferred from one area of the strip to another to help block access to those target areas that are most critical. The operation of the shields or other systems can be directed by a play panel control in the bridge or engineering section of the ship. For example, various valves/actuators may be provided so that play participants can direct water resources to various shield effects, as warranted. More sophisticated effects may also be provided. For example, each shield on each ship may be assigned a code at random (e.g. by the computer) and play participants on the other ships may attempt to "crack" the code by pressing buttons in a certain order in order to periodically effect or disrupt the operation of those shields on the other ship to allow easier targeting of critical target areas on that ship. Thus, play participants work together on one ship to provide maximum effectiveness in their targeting of the other ships.

Communication tubes 270 are preferably provided between different areas of each ship so that play participants 160 may communicate with one another. Optionally, communication tubes may also be provided between adjacent ships so that two or more ships can cooperate with another to attack the other ship or multiple ships can cooperate with one another to achieve a mutually desired result such as hitting a central target 150 to achieve a desired effect and which requires the cooperation of all three ships (and perhaps others) to achieve.

Figure 3:
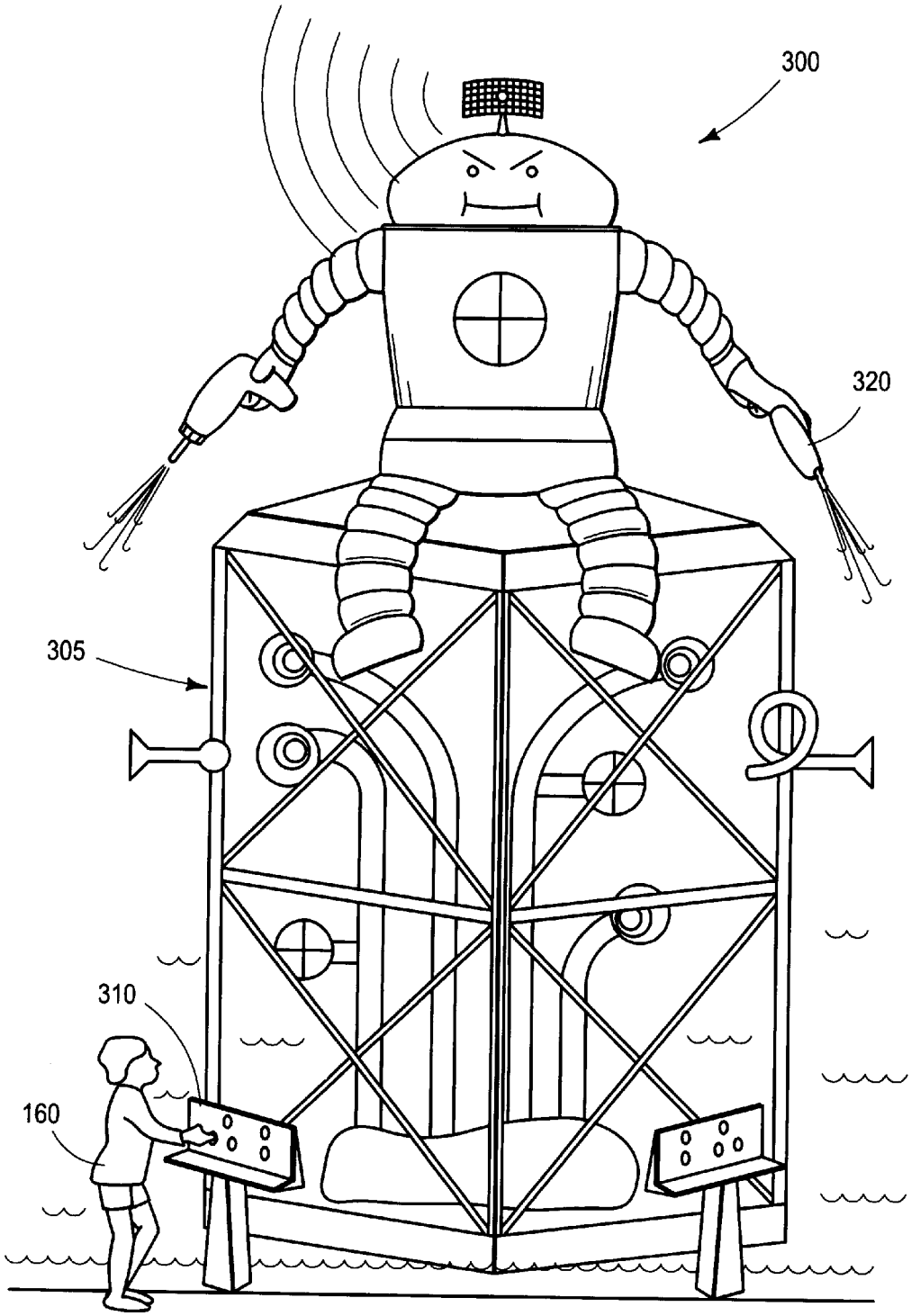
FIG. 3 is a front elevational view of a central target structure incorporating an active targeting feature of the present invention.

For example, the central target may comprise an out-of-control "spraybot" 300 from the planet Zenon (e.g. FIG. 3). Play participants can imagine, for example, that the spraybot has commandeered a critical Earth defense weapons space station 305 and attempting to crack the weapons launch code so that it can mount an all-out attack against the planet Earth.

Optionally, the spraybot has one or more sensors on its head or other parts of its body that can detect the presence and location of play participants 160. Play participants attempt to sneak up and disable the spraybot by entering a particular secret "self-destruct" sequence into a console 310 on the space station 305. But as the play participants are detected, the spraybot quickly turns his head/body around, aims and fires his water cannons 320 directly at the would-be assailant while preferably simultaneously scrambling the self-destruct sequence. Play participants 160 must then figure out the new self-destruct sequence and attempt to divert the robot's attention long enough to allow one or more other play participants 160 to sneak up and enter the correct sequence of buttons/targets that will ultimately "blow up" or deactivate the robot.

Figure 4:
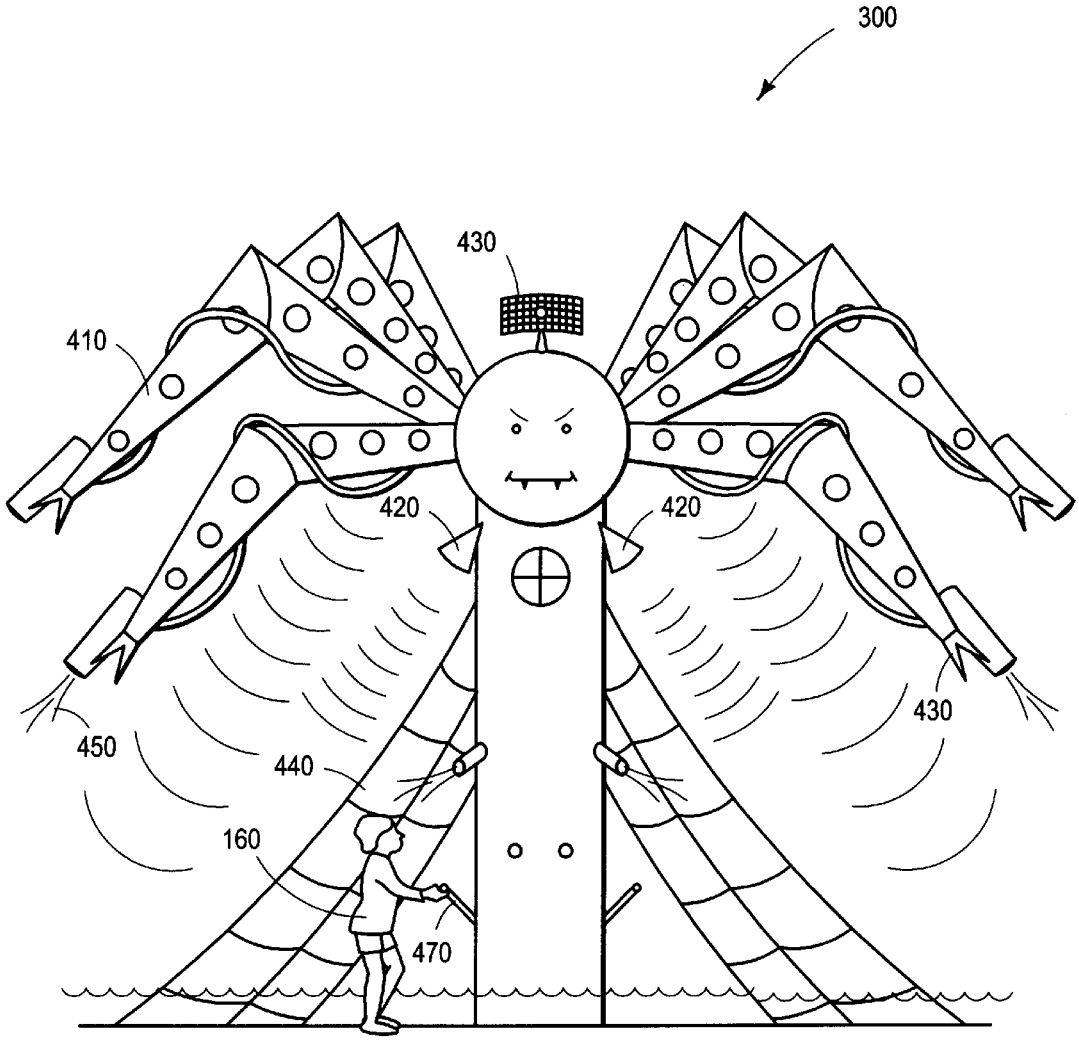
FIG. 4 is a front elevational view of an alternative embodiment of a central target structure incorporating an active targeting feature of the present invention.

A similar central themed target 400 is illustrated in FIG. 4. In this case, a "Spiderbot" 400 provides an exciting and formidable opponent for play participants 160. The Spiderbot preferably has eight legs 410, all independently movable. Each leg 410 is able to move toward play participants 160 as they are sensed by various sensors 420. For example, the spiderbot 400 may be configured to gnash its pinchers 430 at any play participants 160 who dare to come near the spider's web 440 and/or it sprays them with a jet of "spider-web" water 450. Play participants 160 attempt to reach and activate a kill-switch 470 while avoiding being sprayed with water. The legs preferably remain safely elevated above the play participants 160, however, so there is no danger of injury to the play participants. Suitable sensors can be motion sensors, heat/infrared sensors, ultrasonic sensors, beam sensors and the like.

Figure 5:
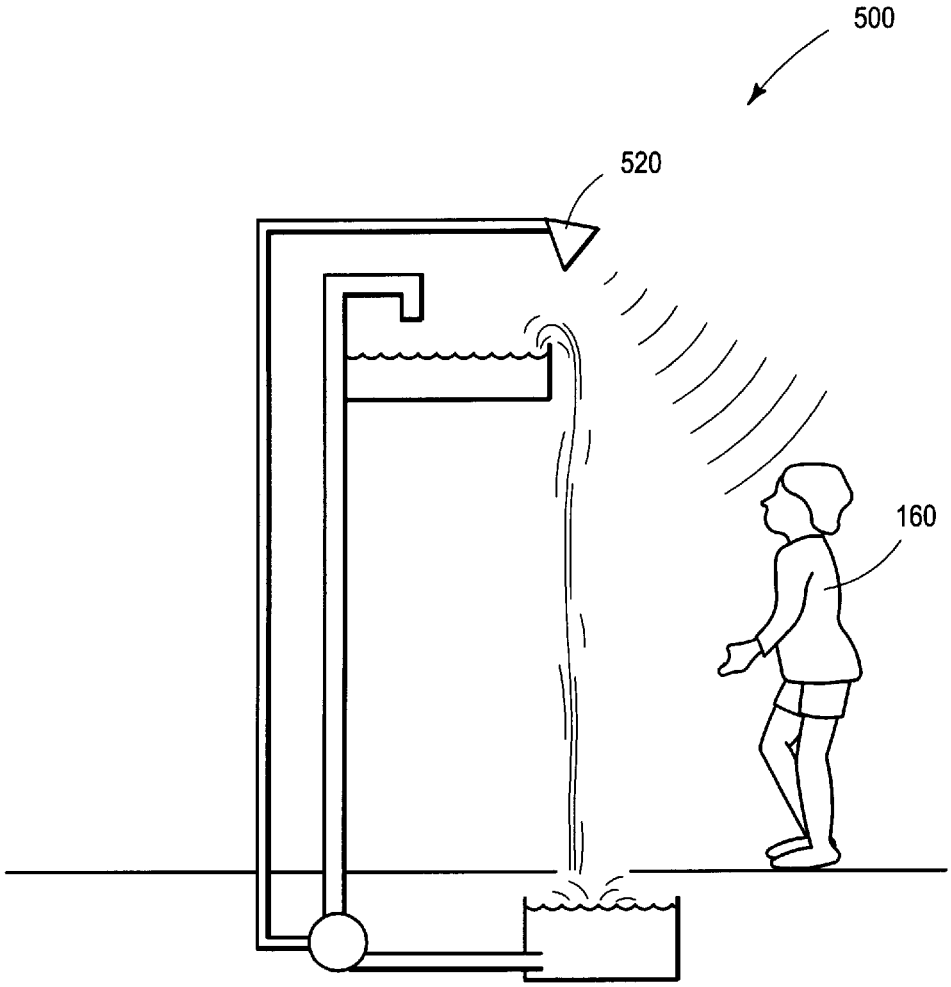
FIG. 5 is a schematic elevation view of an automated water curtain doorway having features and advantages in accordance with the present invention.

Another complimentary play effect in and/or around each space ship play structure may be automated "doors" 500 (FIG. 5) provided by a smooth sheet of water 510 which stream down in a doorway. A sensor 520 mounted adjacent the door entry can sense when a play participant 160 is near the door and the water curtain 510 can be automatically shut off to allow dry or semi-dry entry and exiting through the door. Similarly, this effect can also be used to provide a simulated force field containment system, for example, for containing play-participant "prisoners" within a brig on the ship. The force field can be activated or deactivated from one side, but not from the other such that once a play participant is locked in the brig, the force field cannot be deactivated from inside. The play participant either stays in the brig or gets wet walking through the "force-field."

While the play structures and elements described above are discussed in the context of a wet play environment with water being used as the primary play medium, those skilled in the art will readily recognize that the various systems and components can also be adapted for dry or semi-dry play environments using a variety of play media, such as water, slime, foam balls, plastic balls, Styrofoam and the like.

Example Simulation Sequence

The play simulation begins with each ship coming under attack by the other ships (and/or other unseen ships). Weapons systems are manned by play participants on each ship in order to execute suitable counter measures and launch counter-attacks. Weapons may include, for example, pump guns ("phasers"), water bombs ("photon torpedoes"), spray guns, ball launchers, and the like. The various weapon controls direct water and/or other impact-safe projectiles to be launched at strategic targets located on opposing ships. These strategic targets may include, for example, critical weapons systems, shield/deflector systems, thrusters and, most critical of all, the core containment field. As each target is successfully struck, an impact event is simulated (e.g. noise, vibration, flashing lights, etc.) and a damage report is announced on the target ship (e.g. "phasers inoperable," "hull damage," "forward shields down," etc.).

Simulated impact/damage effects may be provided by, for example, sound effects, vibration, spraying/bursting pipe effects, smoke (water or CO2 vapor), light flashes, simulated explosions, and the like. The number and/or intensity of the damage effects may escalate or progress from simple decreases in the available strength, power or effectiveness of the affected system(s), to complete depletion of the affected system(s) strength, power, or effectiveness, to ultimate catastrophic failure, such as simulated water explosions, dumping water and/or spraying of water/vapor from pipes, and the like.

As successive attacks are launched and targets are successfully hit, the affected systems and components sustain more and more damage. Of course, the ultimate failure mode is a "core breach." As this condition is approached by successive direct target hits, the computer announces "core containment field compromised" "core containment field unstable," "core containment field down," and, the ultimate failure mode, "core breach imminent." The same or similar effects may be provided for individual weapons systems, various shield defenses, force fields, propulsion systems, life support systems, and the like. Thus, a contest is created between play participants on one ship versus play participants on the other ship to see who can hit the targets faster and better.

As damage is incurred to each ship, other play participants (e.g., in an engineering portion of each ship) attempt to counteract and repair the damage to the various critical systems by turning cranks, flipping switches, pushing buttons and the like in order to divert limited power resources (water flow) away from failing or less critical systems to more critical components as requested by other play participants on the bridge. Play participants can make "repairs" to affected systems by carrying out a predetermined sequence of steps, solving a puzzle, pumping a handle, or the like to restore the system back to full-operational. Anticipation and excitement builds as play participants race to shut down and repair damaged systems while diverting precious water resources to more critical operational systems.

Once the ultimate failure mode occurs (e.g., a core breach), the entire ship is disabled while various catastrophic damage effects take place, e.g., splashing/dumping water, spraying water, smoke vapors, etc. After that, the ship shuts down for a predetermined period while it recharges all of its necessary systems to full capacity. Once it is recharged, it is allowed to come online again as a fully charged ship ready to do battle. The other ships can continue to operate on a continual basis, or all three ships can be shut down and periodically recharged so as to provide discrete play intervals as desired.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive play structure comprising a play media propelling or spraying effect with an active targeting system comprising one or more motion sensors mounted on a movable body, said one or more motion sensors being configured and adapted to detect the presence or location of a play participant playing in, on or around the play structure for automatically sensing the location of a play participant and spraying or propelling water or other play media substantially at the sensed location.

2. The interactive play structure of claim 1 wherein the play media comprises water.

3. An interactive play structure comprising a play media propelling or spraying effect with an active targeting system comprising one or more sensors mounted on a movable body, said one or more sensors being configured and adapted to detect the presence or location of a play participant playing in, on or around the play structure for automatically sensing the location of a play participant and spraying or propelling water or other play media substantially at the sensed location and wherein the play media comprises one or more of the following: foam balls, plastic balls, Styrofoam, or slime.

4. The interactive play structure of claim 3 wherein the active targeting system comprises a motion sensor.

5. The interactive play structure of claim 4 wherein at least one of the sensors comprises a motion sensor, heat/infrared sensor, ultrasonic sensor, or a beam sensor.

6. The interactive play structure of claim 4 wherein the movable body comprises an animated themed target structure.

7. The interactive play structure of claim 6 wherein the animated themed target comprises a spiderbot or a spraybot.

8. The interactive play structure of claim 7 wherein the animated themed target further comprises play-participant activated means for deactivating the animated themed target.

9. An interactive play structure comprising a play media propelling or spraying effect with an active targeting system comprising one or more sensors mounted on a movable body, said one or more sensors being configured and adapted to detect the presence or location of a play participant playing in, on or around the play structure for automatically sensing the location of a play participant and spraying or propelling water or other play media substantially at the sensed location and further comprising means for producing vibrating or jolting of the play structure.

10. An interactive play system for entertaining one or more play participants using a movable play media, comprising:

at least one play structure adapted to safely support play participants playing in, on or around the play structure;

multiple play-participant-operated devices disposed throughout the play structure, each said device being arranged and adapted to create one or more desired play effects using a first quantity or/or flow rate of movable play media;

a reservoir adapted to receive and store a second quantity of play media and to supply the stored play media to the play-participant-operated devices;

at least one play-participant operated actuator or switch adapted to control the quantity and/or flow rate of play media supplied from the reservoir to each of the play-participant-operated devices; and means for periodically or selectively disabling or rendering ineffective one or more play-participant-operated devices;

whereby play participants are encouraged to monitor various play-participant-operated devices and to divert play media away from any devices that are rendered ineffective in order to conserve the use of stored play media.

11. The interactive play system of claim 10 wherein the play media comprises water.

12. The interactive play system of claim 10 wherein the play media comprises one or more of the following: foam balls, plastic balls, Styrofoam, or slime.

13. The interactive play system of claim 10 comprising two or more similarly configured play structures.

14. The interactive play system of claim 13 wherein each play structure has associated with it one or more targets which, when activated, disable or render ineffective one or more play-participant-operated devices which are associated with the activated target.

15. The interactive play system of claim 10 further comprising at least one active targeting system including one or more sensors mounted on a movable body, said one or more sensors being configured and adapted to detect the presence or location of a play participant playing in, on or around the play structure and to react thereto.

16. The interactive play system of claim 10 wherein the play structure further comprises means for producing vibrating or jolting of the play structure.

17. The interactive play system of claim 16 wherein the play structure further comprises means for producing sound and/or light effects in coordination with said vibrating or jolting.

18. An interactive play system for entertaining one or more play participants using a movable play media, comprising:

at least one play structure adapted to safely support play participants playing in, on or around the play structure;

multiple play-participant-operated devices disposed throughout the play structure, each said device being arranged and adapted to create one or more desired play effects using a first quantity or/or flow rate of movable play media;

a reservoir adapted to receive and store a second quantity of play media and to supply the stored play media to the play-participant-operated devices;

at least one play-participant operated actuator or switch adapted to control the quantity and/or flow rate of play media supplied from the reservoir to each of the play-participant-operated devices; and a themed target comprising at least one active targeting system including one or more sensors mounted on a movable body, said one or more sensors being configured and adapted to detect the presence or location of a play participant playing in, on or around the play structure and to react thereto.

19. The interactive play system of claim 18 wherein at least one of the sensors comprises a motion sensor, heat/infrared sensor, ultrasonic sensor, or a beam sensor.

20. The interactive play system of claim 18 wherein the movable body comprises an animated themed target structure.

21. The interactive play system of claim 20 wherein the animated themed target comprises a spiderbot or a spraybot.

22. The interactive play system of claim 18 wherein the animated themed target further comprises play-participant-activated means for deactivating the animated themed target.

23. The interactive play system of claim 18 wherein the play structure further comprises means for producing vibrating or jolting of the play structure.

24. The interactive play system of claim 23 wherein the play structure further comprises means for producing sound and/or light effects in coordination with said vibrating or jolting.

25. An interactive competition play system for entertaining one or more play participants using a movable play media, comprising:

two or more play structures adapted to safely support play participants playing in, on or around each play structure;

various play-participant-operated devices disposed throughout each play structure, each device being arranged and adapted to create one or more desired play effects using the movable play media;

one or more play media-activated targets associated with each play structure and adapted, when activated, to disable or render ineffective one or more corresponding play-participant-operated devices, whereby play participants on each play structure compete to so see who can activate the most targets and thereby disable or render ineffective the various play-participant-operated devices on each other play structure; and an animated themed target comprising at least one active targeting system including one or more sensors mounted on a movable body, said one or more sensors being configured and adapted to detect the presence or location of a play participant playing in, on or around the play structure and to react thereto.

26. The interactive play system of claim 25 further comprising means for periodically or selectively disabling or rendering ineffective one or more play-participant-operated devices, whereby play participants are encouraged to monitor various play-participant-operated devices and to divert play media away from any devices that are rendered ineffective in order to conserve the use of stored play media.

27. The interactive play system of claim 25 wherein the play media comprises water.

28. The interactive play system of claim 25 wherein the play media comprises one or more of the following: foam balls, plastic balls, Styrofoam, or slime.

29. The interactive play system of claim 25 wherein at least one of the sensors comprises a motion sensor.

30. The interactive play system of claim 29 wherein at least one of the sensors comprises a heat/infrared sensor, ultrasonic sensor, or a beam sensor.

31. The interactive play system of claim 29 wherein the animated themed target comprises a spiderbot or a spraybot.

32. The interactive play system of claim 29 wherein the animated, themed target further comprises play-participant-activated means for deactivating the animated themed target.

33. The interactive play system of claim 25 wherein each play structure further comprises means for producing vibrating or jolting of the play structure.

34. The interactive play system of claim 25 wherein each play structure further comprises means for producing sound and/or light effects in coordination with said vibrating or jolting.

35. The interactive play system of claim 25 further comprising one or more play-participant-operated shields for shielding one or more associated targets.

36. The interactive play system of claim 35 wherein at least one of the play-participant-operated shields comprises a gravity induced flow of play media.

37. The interactive play system of claim 36 wherein at least one of the play-participant-operated shields comprises a water curtain.

38. A play structure for entertaining one or more play participants, comprising:

an arrangement of one or more generally discrete play spaces sized and arranged to allow safe ingress and egress to play participants playing in, on or around the play structure;

one or more doorways dividing two or more of said play spaces, each doorway comprising an overhead weir adapted to create a curtain of water flowing in the doorway; and one or more play-participant-activated devices arranged and adapted to turn the curtain of water in each associated doorway on or off.

39. The play structure of claim 38 wherein at least one of the play-participant-activated devices comprises a sensor mounted adjacent the door, the sensor being arranged and adapted to automatically turn off the curtain of water when an approaching play participant is detected.

* * * * *